US009661960B2

(12) United States Patent
Cho

(10) Patent No.: US 9,661,960 B2
(45) Date of Patent: May 30, 2017

(54) WATERLESS URINAL

(71) Applicant: ECOSH CO., LTD., Seongnam (KR)

(72) Inventor: Soo Hyun Cho, Seongnam (KR)

(73) Assignee: ECOSH CO., LTD., Seongnam (KR)

( * ) Notice: Subject to any disclaimer, the term of this patent is extended or adjusted under 35 U.S.C. 154(b) by 324 days.

(21) Appl. No.: 14/384,387

(22) PCT Filed: Mar. 12, 2013

(86) PCT No.: PCT/KR2013/001967
§ 371 (c)(1),
(2) Date: Sep. 11, 2014

(87) PCT Pub. No.: WO2013/137614
PCT Pub. Date: Sep. 19, 2013

(65) Prior Publication Data

US 2015/0121613 A1 May 7, 2015

(30) Foreign Application Priority Data

Mar. 13, 2012 (KR) ..... 10-2012-0025501

(51) Int. Cl.
*A47K 11/00* (2006.01)
*A47K 11/12* (2006.01)
*E03D 13/00* (2006.01)

(52) U.S. Cl.
CPC ..... *A47K 11/12* (2013.01); *E03D 13/007* (2013.01)

(58) Field of Classification Search
CPC ..... A47K 11/12; E03D 13/007
USPC ..... 4/144.1–144.4
See application file for complete search history.

(56) References Cited

U.S. PATENT DOCUMENTS

| | | | | |
|---|---|---|---|---|
| 4,948,092 | A | 8/1990 | Kasper | |
| 2008/0160371 | A1 | 7/2008 | Spahr et al. | |
| 2011/0016619 | A1* | 1/2011 | Keller | E03D 13/005 4/222 |

FOREIGN PATENT DOCUMENTS

| | | | |
|---|---|---|---|
| JP | 07-012250 | A | 1/1995 |
| KR | 10-2001-0022651 | A | 3/2001 |
| KR | 10-2005-0084278 | A | 8/2005 |

* cited by examiner

*Primary Examiner* — Christine Skubinna
(74) *Attorney, Agent, or Firm* — Patent Office of Dr. Chung Park

(57) ABSTRACT

The present invention relates to a waterless urinal, in which a urine guide rod of a urine guide member is coupled to a discharge guide surface of a discharge guide member such that a discharge guide surface is quickly opened by urine moving to the urine guide member, thereby increasing a drainage velocity of urine, and thus sludge, scale, and a urinary calculus formed by the protein of urine are not generated, such that the function of the discharge guide surface may be maintained.

7 Claims, 8 Drawing Sheets

WATERLESS URINAL

CROSS-REFERENCE TO PRIOR APPLICATIONS

This application is a national Stage Patent Application of PCT International Patent Application No. PCT/KR2013/001967, filed on Mar. 12, 2013 under 35 U.S.C. §371, which claims priority of Korean Patent Application No. 10-2012-0025501, filed on Mar. 13, 2012, which are all hereby incorporated by reference in their entirety.

TECHNICAL FIELD

The present invention relates to a waterless urinal, and more particularly, to a waterless urinal, in which urine moving to a urine guide member moves to a guide rod coupling groove of a discharge guide member through a urine guide rod, and at the same time, a discharge guide surface is quickly opened by the moving urine, thereby increasing a drainage velocity of urine, to prevent sludge, scale, and a urinary calculus formed by the protein of urine from being generated, such that the function of the discharge guide surface may be maintained.

BACKGROUND ART

Because public health regulations state that an offensive odor or gas generated from drain pipes should be sealed and isolated, the urinal installed on a wall in a toilet needs to discharge urine and water through the drain pipe when a user urinates, and prevent a reverse flow of an offensive odor by residual water remaining at an upper end portion of the drain pipe.

However, the aforementioned urinal has problems in that because a large amount of water is used when the user flushes the urinal, water resources are exhausted and maintenance costs are increased, and an offensive odor is generated by urine remaining in residual water.

In order to solve the aforementioned problems, a fluid control valve has been recently published in Korean Patent Application Laid-Open No. 10-2005-084278.

The aforementioned published patent application has a configuration that provides a constituent element having a flat strip made of a flexible elastic material which terminates at a lower end portion in a support trough-shaped section, and a surface at which an end portion of the strip may be sealed, and may solve the problems in the related art by allowing a fluid to flow only in one direction, but there is a problem in that in a case in which the strip is not restored due to insufficient elasticity, a flow velocity of urine is low, which causes the occurrence of an offensive odor, and a reverse flow of an offensive odor cannot be blocked.

In addition, there is a problem in that an opening and closing function of the strip is lost due to sludge, scale, and a urinary calculus which are generated from the protein of urine that is drained onto the strip and adsorbed onto a surface of the strip, and as a result, it is difficult to block a reverse flow of the offensive odor.

DISCLOSURE

Technical Problem

The present invention has been made in consideration of the aforementioned problems in the related art, and an object of the present invention is to provide a waterless urinal, in which a urine guide rod of a urine guide member is coupled to a discharge guide surface of a discharge guide member so as to allow a discharge guide surface to be quickly opened by urine moving to the urine guide member, thereby increasing a drainage velocity of urine.

In addition, another object of the present invention is to provide a waterless urinal, in which since the discharge guide surface is quickly opened such that a contact area between urine and the discharge guide surface is reduced, sludge, scale, and a urinary calculus formed by the protein of urine are not generated, such that the function of the discharge guide surface may be maintained, and a reverse flow of an offensive odor may be blocked.

Technical Solution

A waterless urinal of the present invention includes:

a first installation guide member which is mounted in an installation hole of the urinal;

a second installation guide member which is fastened and fixed to the first installation guide member so as to allow a urine drainage guide member to be mounted thereto;

the urine drainage guide member which is mounted in the second installation guide member so as to guide drainage of urine;

a discharge guide member which is seated on a catching projection provided in the urine drainage guide member so as to guide drainage of urine and block a reverse flow of an offensive odor; and a urine guide member which has a urine guide rod coupled to a discharge guide surface provided on the discharge guide member so as to guide the guided drainage of urine.

Advantageous Effects

According to the present invention, there is an advantage in that a urine guide rod of a urine guide member is coupled to a discharge guide surface of a discharge guide member so as to allow the discharge guide surface to be easily opened at a high speed by urine moving to the urine guide member, thereby increasing a drainage velocity of urine.

In addition, according to the present invention, there is an advantage in that since the discharge guide surface is quickly opened such that a contact area between urine and the discharge guide surface is reduced, sludge, scale, and a urinary calculus formed by the protein of urine are not generated, such that the function of the discharge guide surface may be maintained, and a reverse flow of an offensive odor may be blocked, thereby improving reliability of a product for a user.

DESCRIPTION OF MAIN REFERENCE NUMERALS OF DRAWINGS

Figure 1:
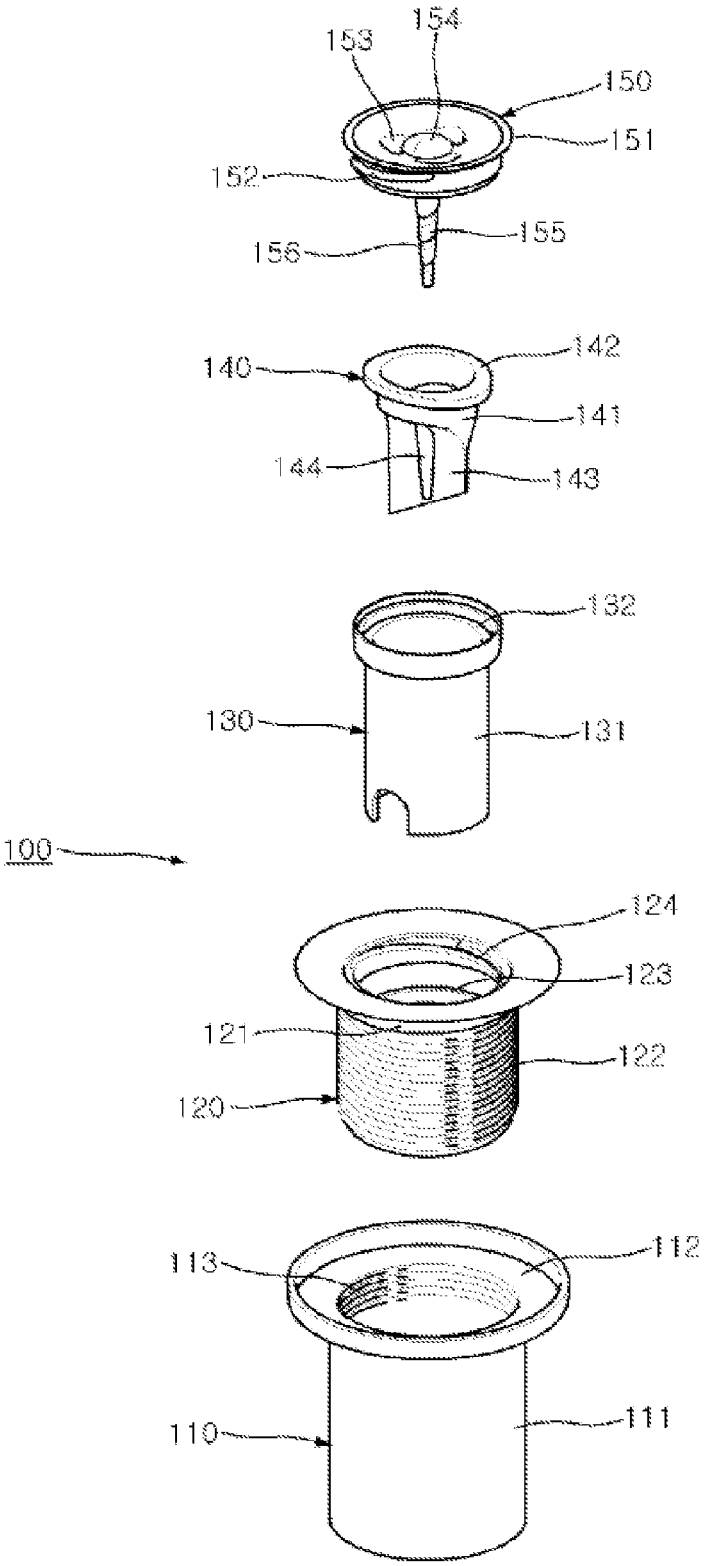
FIG. 1 is an exploded perspective view of the present invention.

100: Waterless urinal
110: First installation guide member
120: Second installation guide member
130: Urine drainage guide member
140: Discharge guide member
150: Urine guide member

BEST MODE

Figure 2:
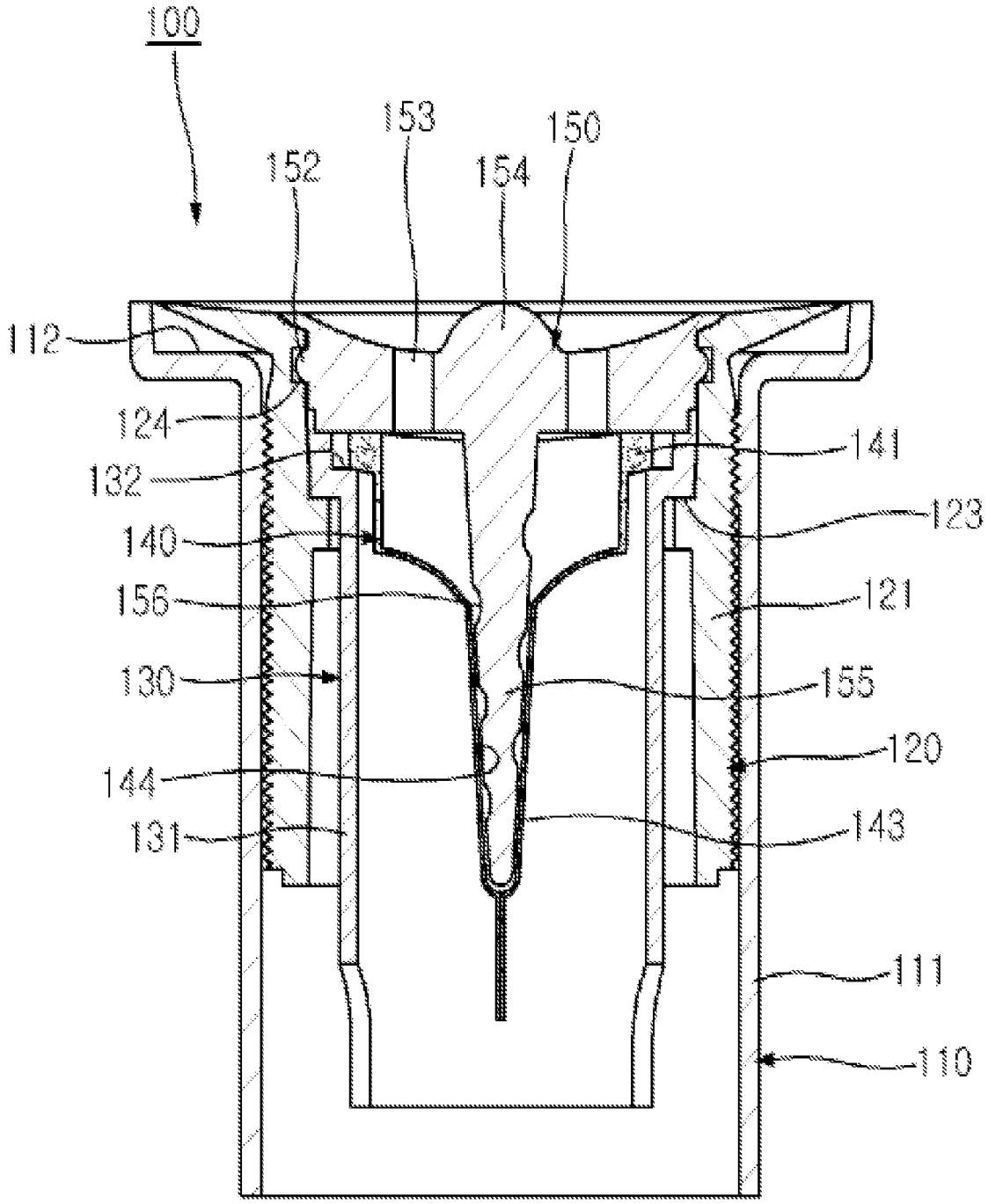
FIG. 2 is a side cross-sectional view of the present invention.
Figure 3:
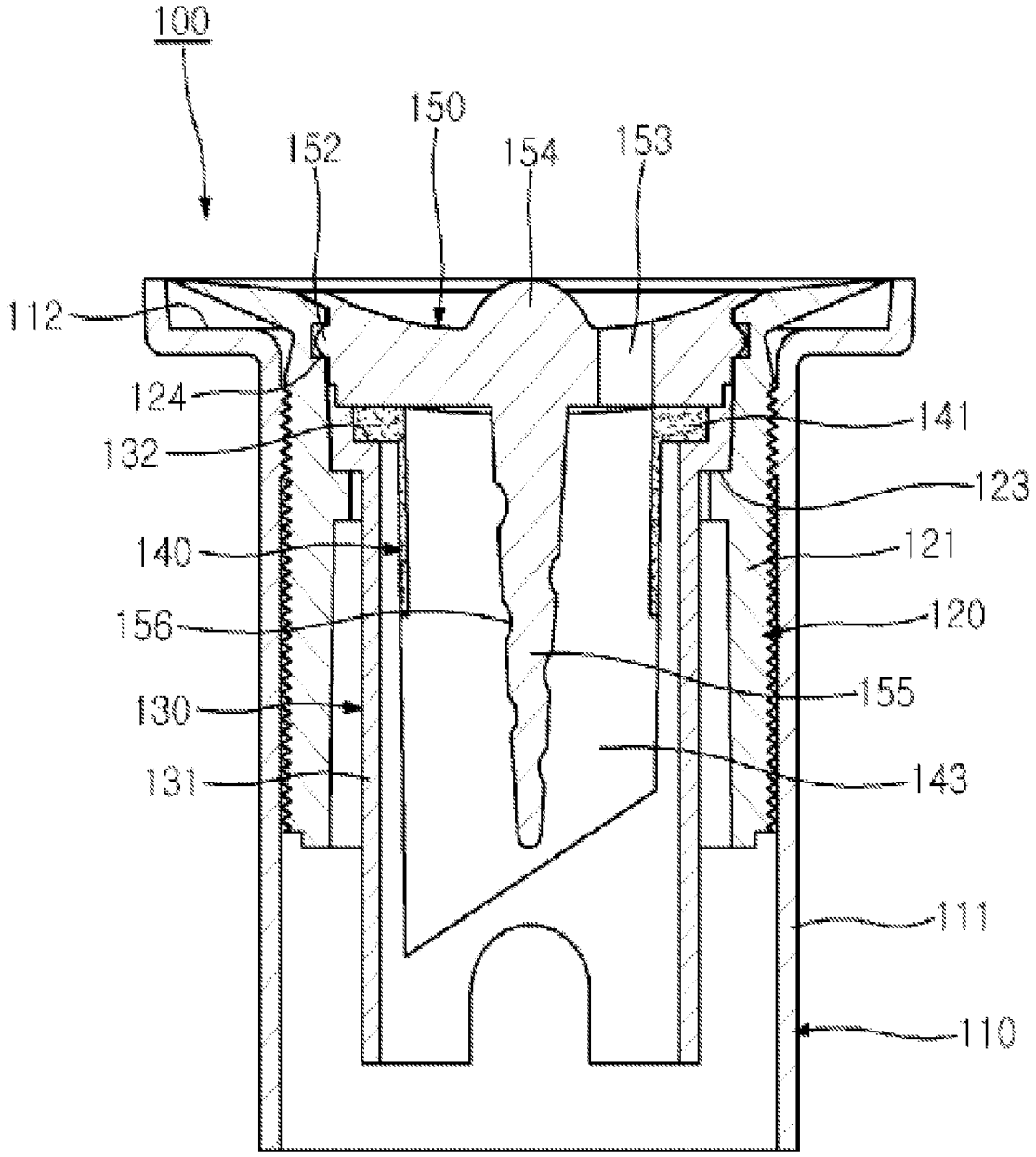
FIG. 3 is a front cross-sectional view of the present invention.

Hereinafter, the present invention will be described in detail with reference to the accompanying drawings. FIG. 1 is an exploded perspective view of the present invention, FIG. 2 is a side cross-sectional view of the present invention, and FIG. 3 is a front cross-sectional view of the present invention.

A waterless urinal 100 of the present invention includes a first installation guide member 110 which is mounted in an installation hole 11 of the urinal 10, a second installation guide member 120 which is fastened and fixed to the first installation guide member 110 and allows a urine drainage guide member 130 to be mounted therein, a urine drainage guide member 130 which is mounted in the second installation guide member 120 and guides drainage of urine, a discharge guide member 140 which is seated on a catching projection 132 provided in the urine drainage guide member 130 and blocks a reverse flow of an offensive odor while guiding drainage of urine, and a urine guide member 150 which has a urine guide rod 155 coupled to a discharge guide surface 143 provided on the discharge guide member 140 and guides the guided drainage of urine, and the waterless urinal 100 will be more specifically described as follows.

The first installation guide member 110 includes a first installation guide body 111 which is mounted in the installation hole 11 of the urinal 10, an installation guide projection 112 which allows the second installation guide member 120 to be seated on an upper end portion of the first installation guide body 111, and an inner circumferential thread 113 which allows an outer circumferential thread 122 of the second installation guide member 120 to be fastened to an inner circumferential surface of the first installation guide body 111.

The second installation guide member 120 includes a second installation guide body 121 which is seated on the first installation guide member 110, the outer circumferential thread 122 which allows an outer circumferential surface of the second installation guide body 121 to be fastened to the inner circumferential thread 113 of the first installation guide body 111, an installation guide projection 123 which allows the urine drainage guide member 130 to be seated on an upper end portion of the second installation guide body 121, and a streamlined installation guide groove 124 which allows the urine drainage guide member 130 to be attached and detached to/from the upper end portion of the second installation guide body 121.

The urine drainage guide member 130 includes a urine drainage guide body 131 which is seated on the second installation guide member 120, and a catching projection 132 which protrudes at an upper end portion of the urine drainage guide body 131 and is seated on the installation guide projection 123 of the second installation guide member 120.

The discharge guide member 140 includes a discharge guide body 141 which is coupled to the urine guide member 150, a catching piece 142 which protrudes at an upper end portion of the discharge guide body 141 and is seated on the catching projection 132 of the urine drainage guide member 130, the discharge guide surface 143 which is opened by urine supplied to a lower end portion of the discharge guide body 141 so as to discharge urine, and restored by its own elasticity when urine is not supplied thereto, and a guide rod coupling groove 144 which protrudes on the discharge guide surface 143 and allows the urine guide rod 155 of the urine guide member 150 to be coupled thereto.

The urine guide member 150 includes a urine guide body 151 which is seated on the discharge guide member 140 and has an installation guide projection 152 that is formed on an outer circumferential surface of the urine guide body 151 so as to be fastened to the installation guide groove 124 of the second installation guide member 120, urine drainage holes 153 which radially penetrate the urine guide body 151 so as to guide drainage of urine, a urine guide projection 154 which protrudes on the urine guide body 151 so as to guide drainage of urine toward the urine drainage holes 153, and the urine guide rod 155 which protrudes on a bottom surface of the urine guide body 151.

The urine guide rod 155 has a wide upper portion and a narrow lower portion.

The urine guide rod 155 includes a guide groove 156 which protrudes in a streamlined shape on an outer circumferential surface of the urine guide rod 155 so as to guide drainage of urine.

Figure 4:
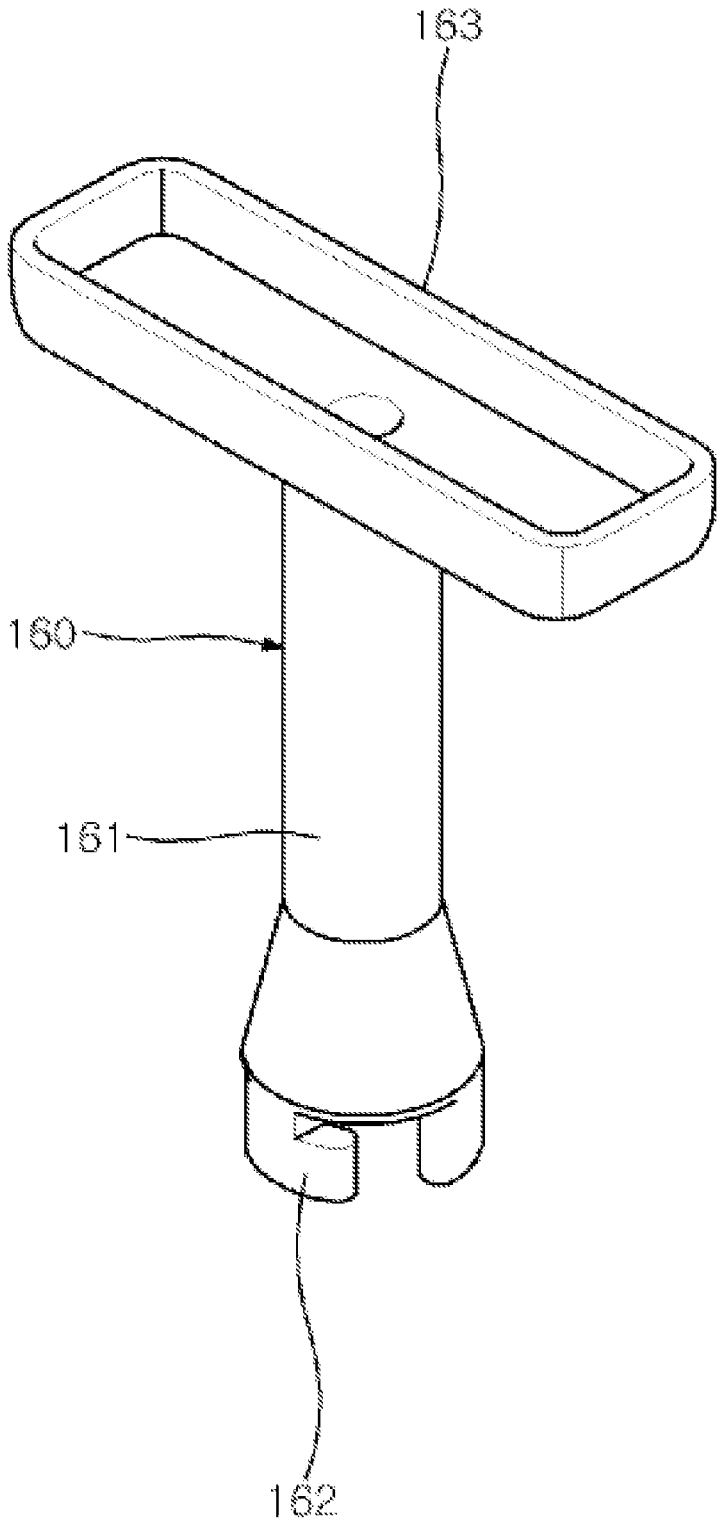
FIG. 4 is a perspective view illustrating an attaching and detaching member of the present invention.

As illustrated in FIG. 4, an attaching and detaching member 160, which attaches and detaches the urine guide member 150 to/from the second installation guide member 120, is further provided, and the attaching and detaching member 160 includes a coupling projection 162 which protrudes on an attaching and detaching body 161 so as to be coupled to the urine drainage hole provided in the urine guide member 150, and a knob 163 which is formed at a side of the attaching and detaching body 161 opposite to the side at which the coupling projection 162 protrudes.

Installation and operational processes of the waterless urinal 100 of the present invention, which is configured as described above, will be described as follows.

First, in a state in which the second installation guide body 121 of the second installation guide member 120 is coupled to the first installation guide body 111 of the first installation guide member 110 such that the outer circumferential thread 122 of the second installation guide body 121 engages with the inner circumferential thread 113 of the first installation guide body 111, the second installation guide body 121 is rotated in one direction so as to allow the outer circumferential thread 122 to be fastened to the inner circumferential thread 113.

When the outer circumferential thread 122 is fastened to the inner circumferential thread 113, the upper end portion of the second installation guide body 121 is seated on the installation guide projection 112 of the first installation guide body 111, such that the first installation guide body 111 is closed.

When the first installation guide member 110 to which the second installation guide member 120 is coupled is coupled to the installation hole 11 of the urinal 10, an outer circumferential surface of the first installation guide member 110 is coupled to an inner circumferential surface of the installation hole 11 while coming into surface-to-surface contact with the inner circumferential surface of the installation hole 11, and the first installation guide member 110 and the installation hole 11 are finished by a separate finishing member, such that urine is not drained between the first installation guide member 110 and the installation hole 11.

In addition, when the urine drainage guide body 131 of the urine drainage guide member 130 is coupled to the second installation guide body 121 of the second installation guide member 120, the urine drainage guide body 131 is completely coupled into the second installation guide body 121 while the upper end portion of the urine drainage guide body 131 is seated on the installation guide projection 123 of the second installation guide body 121, and the discharge guide body 141 of the discharge guide member 140, which is made of a silicone material, is coupled to the urine drainage guide body 131 of the urine drainage guide member 130.

In this case, the discharge guide surface 143 formed at the lower end portion of the discharge guide body 141 is completely coupled into the urine drainage guide body 131 while the catching piece 142 formed at the upper end portion of the discharge guide body 141 is seated on the catching projection 132 of the urine drainage guide body 131, and the urine guide body 151 of the urine guide member 150 is coupled to the discharge guide body 141 of the discharge guide member 140.

Figure 5:
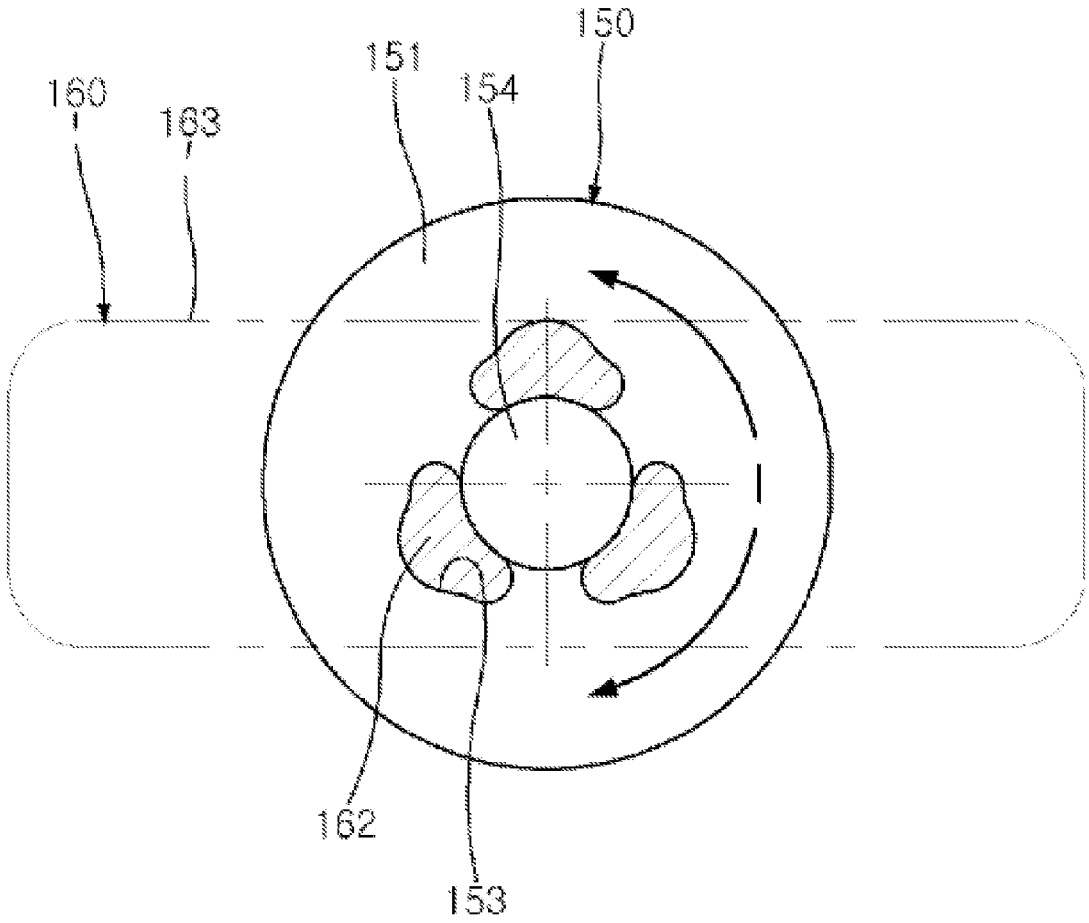
FIG. 5 is a process view illustrating an installation state of the present invention using the attaching and detaching member of FIG. 4.

The urine guide rod 155, which is provided at the lower end portion of the urine guide body 151 and has the guide groove 156 formed therein, is coupled to the guide rod coupling groove 144 while passing through the interior of the discharge guide body 141, such that the urine guide rod 155 comes into contact with an inner surface of the guide rod coupling groove 144, and at the same time, a bottom surface of the urine guide body 151 comes into close contact with the upper end portion of the discharge guide body 141, that is, the catching piece 142, and in this case, as illustrated in FIG. 5, the coupling projection 162, which protrudes on the attaching and detaching body 161 of the attaching and detaching member 160, is coupled to the urine drainage hole 153, and thereafter, the knob 163 of the attaching and detaching member 160 is rotated in one direction.

Figure 6:
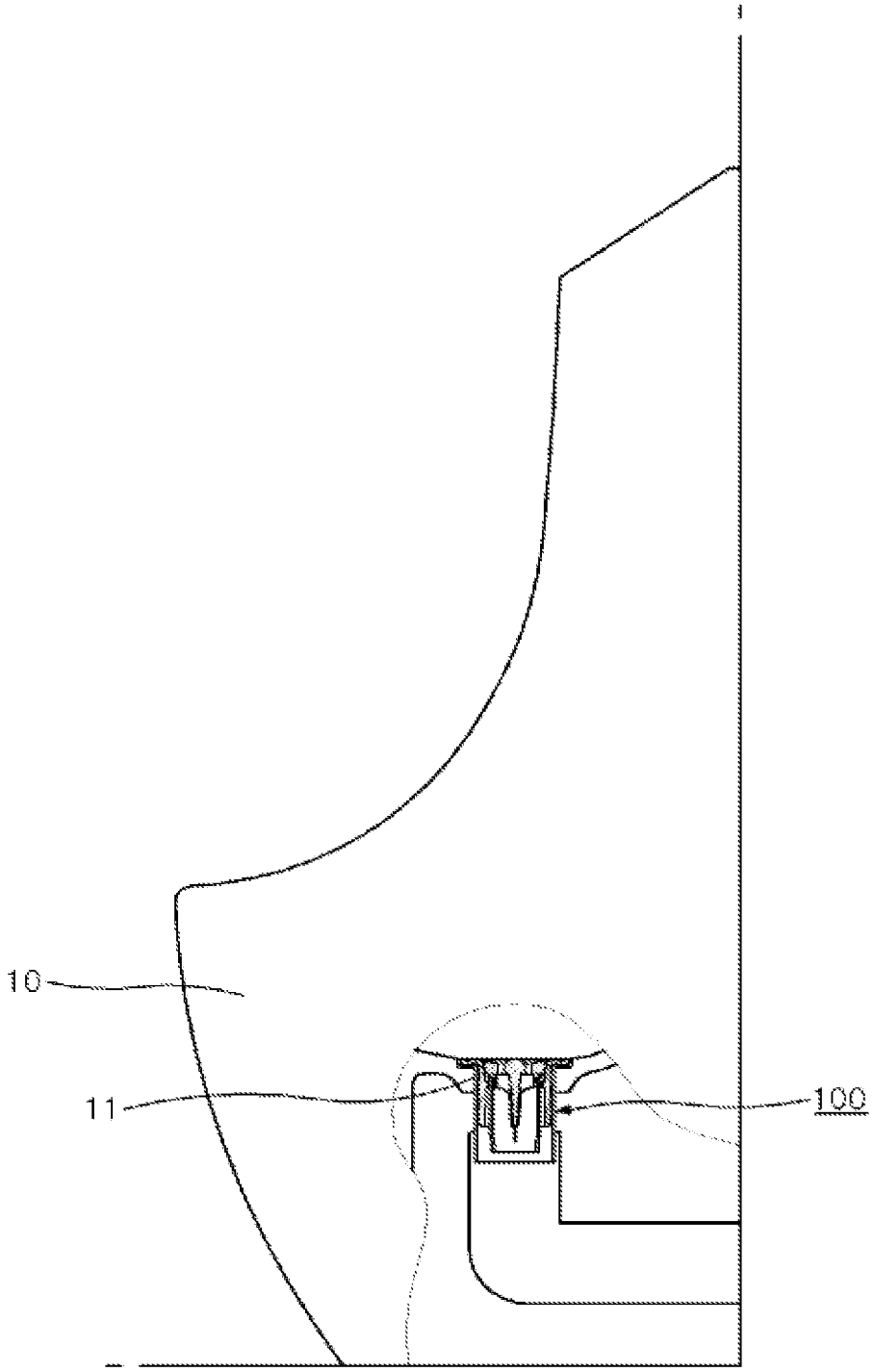
FIG. 6 is an installation state view of the present invention.

As the knob 163 is rotated in one direction, the attaching and detaching body 161, the coupling projection 162, and the urine guide body 151 having the urine drainage hole 153 to which the coupling projection 162 is coupled, are rotated in one direction, and at the same time, the installation guide projection 152, which is formed in a streamlined shape on the outer circumferential surface of the urine guide body 151, is fastened and coupled to the installation guide groove 124 that is formed in a streamlined shape in the inner circumferential surface of the second installation guide body 121 of the second installation guide member 120, such that the urine guide body 151 of the urine guide member 150 presses the catching piece 142 of the discharge guide member 140, and the catching piece 142 is compressed and deformed between the urine guide body 151 and the catching projection 132 of the urine drainage guide member 130 so as to tightly close the urine guide body 151 and the catching projection 132, and as a result, the installation of the waterless urinal 100 is completed as illustrated in FIG. 6.

Figure 7:
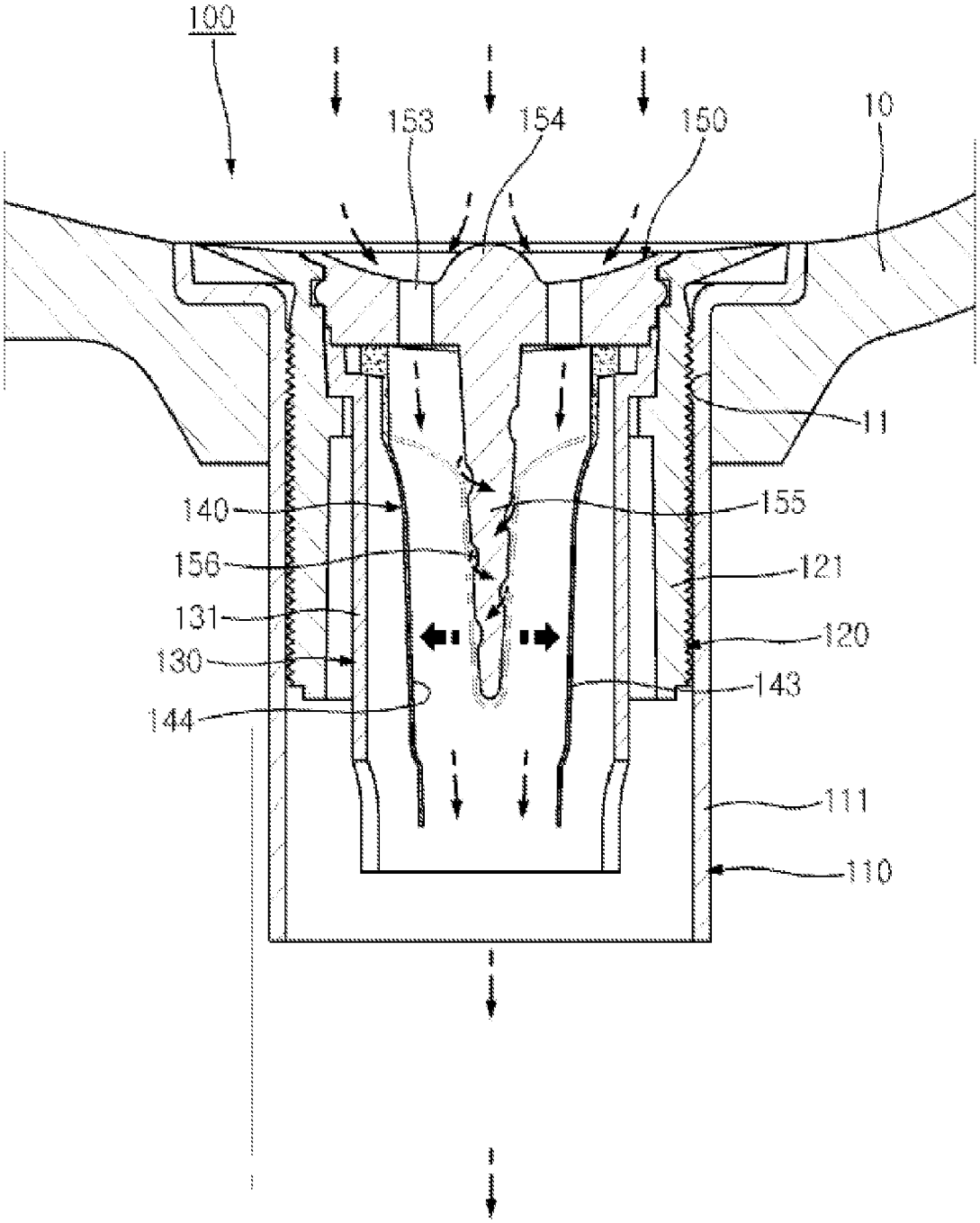
FIGS. 7 and 8 are operational state views of the present invention.
Figure 8:
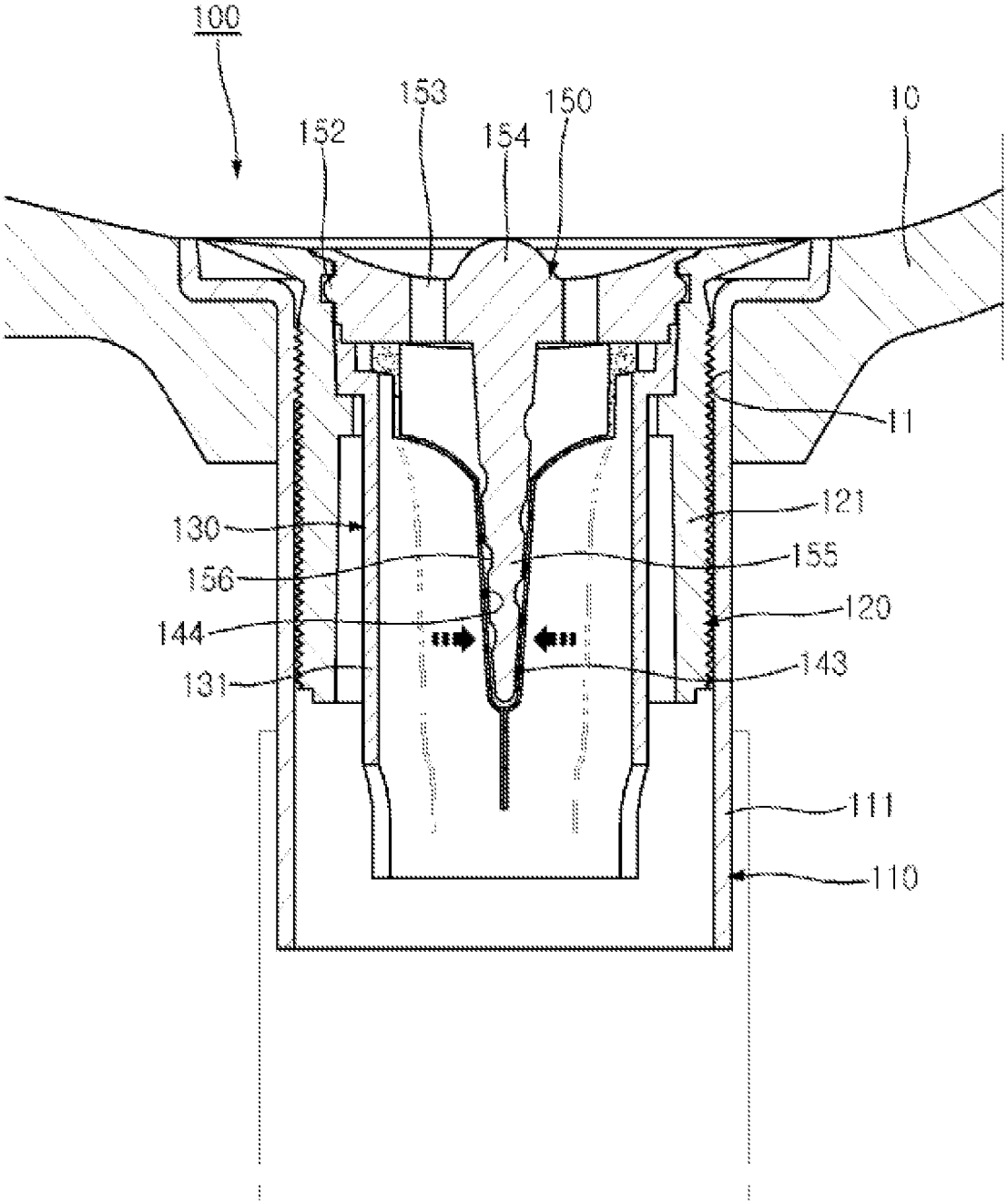

As illustrated in FIGS. 7 to 8, when a user urinates into the waterless urinal 100 of the present invention, which is completely installed as described above, the urine from the user flows downward along an inner surface of the urinal 10 and moves to an upper surface of the urine guide body 151, and because the upper surface of the urine guide body 151 is formed to be curved downward, the urine is smoothly moved, and the urine, which has been moved to the upper surface of the urine guide body 151, is drained to the urine drainage hole 153.

In this case, the urine is drained to the urine drainage hole 153 by the urine guide projection 154 that protrudes at a center of the urine guide body 151.

The urine drained to the urine drainage hole 153 moves between the urine guide rod 155 and the guide rod coupling groove 144 along an inclined inner surface of the discharge guide body 141, and at the same time, quickly flows downward along the guide groove 156, which is recessed in a streamlined shape in the outer circumferential surface of the urine guide rod 155, so as to presses the lower end portion of the guide rod coupling groove 144 and the discharge guide surface 143, and the discharge guide surface 143 is spread and opened by the urine flowing downward along the guide groove 156, such that the urine may be quickly drained along the opened discharge guide surface 143.

The urine drained to the discharge guide surface 143 is drained to a septic tank along a pipe installed to the installation hole 11 of the urinal 10, and when the urine is completely drained and no urine flows downward to the urine guide member 150 along the inner surface of the urinal 10, the discharge guide surface 143, which has been spread by the movement of urine, is restored by its own elasticity, and portions of the discharge guide surface 143 come into surface-to-surface contact with each other so as to close the discharge guide body 141, such that the urinal 10 waits for the next operation.

In addition, in a case in which it is necessary to replace the discharge guide member 140 after the aforementioned processes are repeatedly performed, the urine guide member 150 may be separated from the second installation guide member 120 using the attaching and detaching member 160, and thereafter the discharge guide member 140 may be separated from the urine drainage guide member 130 and replaced, and a new discharge guide member may be seated on the urine drainage guide member 130, and thereafter, the urine guide member 150 is mounted in the second installation guide member 120, and as a result, the urinal may be used.

While the present invention has been described above with reference to the limited exemplary embodiments and drawings, terms or words used in the present specification and the claims should not be interpreted as a general and dictionary meaning and should be interpreted as a meaning and a concept which conform to the technical spirit of the present invention. Accordingly, since the exemplary embodiments disclosed in the present specification and the configurations illustrated in the drawings are just the exemplary embodiments of the present invention and do not fully represent the technical spirit of the present invention, it should be appreciated that various equivalents and modified examples may be made without departing from the scope of the claims of the present invention.

The invention claimed is:

1. A waterless urinal comprising:

a first installation guide member which is mounted in an installation hole of the urinal;

a second installation guide member which is fastened and fixed to the first installation guide member so as to allow a urine drainage guide member to be mounted thereto;

the urine drainage guide member which is mounted in the second installation guide member so as to guide drainage of urine;

a discharge guide member which is seated on a catching projection provided in the urine drainage guide member so as to guide drainage of urine and block a reverse flow of an offensive odor; and a urine guide member which has a urine guide rod coupled to a discharge guide surface provided on the discharge guide member so as to guide the guided drainage of urine, wherein the discharge guide member includes a discharge guide body which is coupled to the urine guide member, a catching piece which protrudes at an upper end portion of the discharge guide body and is seated on the catching projection of the urine drainage guide member, the discharge guide surface which is opened by urine supplied to a lower end portion of the discharge guide body so as to discharge urine, and restored by its own elasticity when urine is not supplied thereto, and a guide rod coupling groove which protrudes on the discharge guide surface so as to allow the urine guide rod of the urine guide member to be coupled thereto.

2. The waterless urinal of claim 1, wherein the urine guide member includes:

a urine guide body which is seated on the discharge guide member and has an installation guide projection that is formed on an outer circumferential surface of the urine guide body so as to be fastened to the installation guide groove of the second installation guide member;

urine drainage holes which radially penetrate the urine guide body so as to guide drainage of urine;

a urine guide projection which protrudes on the urine guide body so as to guide drainage of urine toward the urine drainage holes; and the urine guide rod which protrudes on a bottom surface of the urine guide body.

3. The waterless urinal of claim 2, wherein the urine guide rod has a wide upper portion, and a narrow lower portion.

4. The waterless urinal of claim 1, further comprising:

an attaching and detaching member which attaches and detaches the urine guide member to/from the second installation guide member.

5. The waterless urinal of claim 4, wherein the attaching and detaching member includes:

a coupling projection which protrudes on an attaching and detaching body so as to be coupled to an urine drainage hole provided in the urine guide member; and a knob which is formed at a side of the attaching and detaching body opposite to the side at which the coupling projection protrudes.

6. The waterless urinal of claim 2, further comprising:

a guide groove which protrudes in a streamlined shape on an outer circumferential surface of the urine guide rod so as to guide drainage of urine.

7. The waterless urinal of claim 3, further comprising:

a guide groove which protrudes in a streamlined shape on an outer circumferential surface of the urine guide rod so as to guide drainage of urine.

* * * * *